US010292418B2

(12) United States Patent
Pammer

(10) Patent No.: US 10,292,418 B2
(45) Date of Patent: May 21, 2019

(54) WRAPPING MATERIAL FOR SMOKING ARTICLES WITH DIRECTIONALLY DEPENDENT DIFFUSION CAPACITY

(71) Applicant: DELFORTGROUP AG, Traun (AT)

(72) Inventor: Bernhard Pammer, Linz (AT)

(73) Assignee: delfortgroup AG, Traun (AT)

( * ) Notice: Subject to any disclaimer, the term of this patent is extended or adjusted under 35 U.S.C. 154(b) by 297 days.

(21) Appl. No.: 15/103,902

(22) PCT Filed: Oct. 29, 2014

(86) PCT No.: PCT/EP2014/073227
§ 371 (c)(1),
(2) Date: Jun. 13, 2016

(87) PCT Pub. No.: WO2015/086221
PCT Pub. Date: Jun. 18, 2015

(65) Prior Publication Data

US 2016/0309776 A1 Oct. 27, 2016

(30) Foreign Application Priority Data

Dec. 13, 2013 (DE) ..... 10 2013 114 012

(51) Int. Cl.
*A24D 1/02* (2006.01)
*D21H 27/10* (2006.01)
(Continued)

(52) U.S. Cl.
CPC ..... *A24D 1/02* (2013.01); *A24D 1/025* (2013.01); *A24D 1/08* (2013.01); *A24D 1/10* (2013.01); *D21H 27/10* (2013.01); *D21H 27/30* (2013.01)

(58) Field of Classification Search
CPC combination set(s) only.
See application file for complete search history.

(56) References Cited

U.S. PATENT DOCUMENTS 5,143,099 A 9/1992 Le Gars et al.
5,849,153 A * 12/1998 Ishino ..... A24D 1/02 162/135
(Continued)

FOREIGN PATENT DOCUMENTS

WO WO 2009001223 12/2008
WO WO 2009/105343 8/2009
(Continued)

OTHER PUBLICATIONS

International Searching Authority—European Patent Office, English Translation International Preliminary Report on Patentability, PCT/EP2014/073227, dated Jun. 14, 2016; 15 pages.
(Continued)

*Primary Examiner* — Eric Yaary
(74) *Attorney, Agent, or Firm* — Sunstein Kann Murphy & Timbers LLP

(57) ABSTRACT

A wrapping material for a smoking article is disclosed, which has a laminar shape that extends further in two mutually orthogonal spatial directions X and Y than in a third spatial direction Z orthogonal to the spatial directions X and Y. The wrapping material has, at least in part of its area, a first and a second diffusion capacity $D_1$ and $D_2$ for a diffusion of $CO_2$ through the wrapping material in the +Z-direction and the −Z-direction, respectively, wherein for the first and second diffusion capacity $D_1$ and $D_2$, each an average of 10 values, one or both of the following relationships (i) and (ii) hold:

$$|D_1-D_2|\geq 0.03 \text{ cm/s} \quad \text{(i)}$$

at a probability of error of 1%
(Continued)

$$2\frac{|D_1 - D_2|}{D_1 + D_2} \geq 0.030. \quad \text{(ii)}$$

30 Claims, 2 Drawing Sheets

(51) Int. Cl.

| | |
|---|---|
| ***A24D 1/08*** | (2006.01) |
| ***A24D 1/10*** | (2006.01) |
| ***D21H 27/30*** | (2006.01) |

(56) References Cited

U.S. PATENT DOCUMENTS

| | | | | |
|---|---|---|---|---|
| 6,705,325 | B1 | 3/2004 | Hicks et al. | |
| 2002/0185143 | A1* | 12/2002 | Crooks | A24D 1/02 131/365 |
| 2008/0173320 | A1 | 7/2008 | Dunlap et al. | |
| 2009/0223529 | A1 | 9/2009 | Hampl | |
| 2012/0152266 | A1 | 6/2012 | Volgger | |
| 2013/0118513 | A1* | 5/2013 | Kaljura | A24D 1/02 131/365 |
| 2013/0139838 | A1 | 6/2013 | Volgger | |
| 2014/0299144 | A1* | 10/2014 | Fiebelkorn | A24D 3/04 131/336 |
| 2014/0352906 | A1 | 12/2014 | Jo | |
| 2015/0257438 | A1* | 9/2015 | Jo | A24D 1/025 131/335 |

FOREIGN PATENT DOCUMENTS

| | | |
|---|---|---|
| WO | WO 2013/069868 | 5/2013 |
| WO | WO 2013178492 | 12/2013 |

OTHER PUBLICATIONS

International Search Report in International Application No. PCT/EP2014/073227 dated Mar. 12, 2015, 10 pages.

Spanish Patent Office Search Report, Application No. 201690027, dated Feb. 13, 2019, 7 pages.

* cited by examiner

WRAPPING MATERIAL FOR SMOKING ARTICLES WITH DIRECTIONALLY DEPENDENT DIFFUSION CAPACITY

CROSS-REFERENCE TO RELATED APPLICATIONS

This Application is a U.S. national stage entry under 35 USC § 371 of PCT/EP2014/073227 filed Oct. 29, 2014, which itself claims priority to DE 10 2013 114 012.2 filed Dec. 13, 2013.

The present invention is related to a wrapping material for a smoking article. In particular it is related to a wrapping material, which exhibits a directional diffusion capacity and thereby provides a smoking article with special properties. Furthermore, it is related to a smoking article that comprises this wrapping material.

BACKGROUND AND PRIOR ART

It is generally known that during the combustion of tobacco in smoking articles, many harmful substances are generated. Therefore there exists an interest in the industry to produce smoking articles the smoke from which contains considerably fewer harmful substances.

A smoking article, typically a cigarette, comprises at least one tobacco column, which is wrapped with a wrapping material. In many cases smoking articles are also equipped with filters to influence the type and amount of substances in the smoke. Such filters, mostly made out of cellulose acetate or paper, can reduce the particulate fraction of the smoke. Filters can also contain other substances, such as activated carbon or flavorings.

The amount and type of substances generated during smoking of smoking articles are determined by a method whereby the smoking article is smoked under standardized conditions. Such a method is described in ISO 4387, for example. In it, the smoking article is at first lit at the beginning of the first puff and then each minute a puff is taken at the mouth end of the smoking article with a duration of 2 seconds and a volume of 35 $cm^3$ using a sinusoidal puff profile. The puffs are repeated until the length of the smoking article falls below a length that has been pre-defined in the standard. The smoke exiting the mouth end of the smoking article during the puffs is collected in a Cambridge Filter Pad. Afterwards, the Cambridge Filter Pad is analyzed chemically with respect to its content of various substances, for example nicotine. The gas phase exiting the mouth end of the smoking article through the filter pad during the puffs is collected and also chemically analyzed, for example to determine the carbon monoxide content.

During standardized smoking, the smoking article is in two different states of flow. During a puff, a considerable pressure difference is generated, typically in the range 200 Pa to 1000 Pa between the inner face of the wrapping material, facing the tobacco, and the outer face. Due to the pressure difference, air flows through the wrapping material into the tobacco part of the smoking article and dilutes the smoke generated during a puff. During this phase, which lasts for 2 seconds per puff, the extent of dilution of the smoke is determined primarily by the air permeability of the wrapping material.

In the period between the puffs, however, the cigarette smolders without any considerable pressure difference between the inside of the tobacco column and the surroundings, so that the gas transport between the tobacco column and the surroundings is determined by the gas concentration difference. As a result, carbon monoxide can diffuse through the wrapping material into the ambient air and oxygen can diffuse from the ambient air through the wrapping material into the tobacco column. In this phase, which last 58 seconds per puff according to the method described in ISO 4387, the diffusion capacity of the wrapping material is the relevant parameter for the gas transport.

Apart from the carbon monoxide content in the smoke of a smoking article, the diffusion capacity is also of great importance for the self-extinguishing smoking articles known in the prior art. In such smoking articles, burn-retardant stripes are applied to the wrapping material in order to obtain self-extinguishing in a standardized test (ISO 12863). This or a similar test is, for example, part of the legal regulations in the USA, Canada, Australia and the European Union. The self-extinguishing property is caused by the fact that the wrapping material has a substantially lower diffusion capacity in the region of the stripes than outside these stripes. As a result, the diffusion of oxygen from the surroundings through the wrapping material to the glowing cone of the cigarette is reduced, so that self-extinguishing occurs under certain conditions. The diffusion capacity of a wrapping material of a smoking article can be reduced either by imprinting stripes in the circumferential direction, for example made from starch, alginate, guar or similar materials known in the prior art. Alternatively, a wrapping material can be produced that, due to its composition, already exhibits an intrinsically low diffusion capacity. The areas of reduced diffusion capacity do not need to be present as stripes, instead they can have any other geometry compatible with any legally required self-extinguishing property.

The diffusion capacity is a characteristic property of a wrapping material of a smoking article. It describes the permeability of the material for a gas flow that is caused by a concentration difference. Therefore, it indicates the gas volume passing through the wrapping material per unit time, per unit area and per concentration difference, and hence it has the unit $cm^3/(cm^2\ s)=cm/s$. A measurement of the diffusion capacity for carbon dioxide ($CO_2$) can, for example, be carried out by means of a diffusion capacity measurement instrument from the company Borgwaldt KC (Diffusivity Tester) or Sodium ($CO_2$ Diffusivity Meter).

A measurement of the diffusion capacity can be carried out according to the Recommended Method No. 77 issued by the Cooperation Centre for Scientific Research Relative to Tobacco (CORESTA). In this regard, the sample of the wrapping material is fixed in a measurement chamber after appropriate sample preparation and conditioning according to ISO 187, wherein the sample divides the measurement chamber it two halves of nominally identical geometry, which are only separated by the wrapping material. Carbon dioxide is passed into the first of the two chamber halves, while nitrogen is passed into the second half-chamber. Both gases should flow through the chamber with the same velocity parallel to the surface of the wrapping material and technical measures are taken to ensure that no significant pressure difference exists between both faces of the wrapping material. Due to the concentration difference, carbon dioxide diffuses from the first half of the measurement chamber through the wrapping material into the second half-chamber, while at the same time, nitrogen diffuses from the second half of the measurement chamber through the wrapping material into the first half of the measurement chamber. At the outlet from the second half-chamber, the volumetric concentration of carbon dioxide in the nitrogen flow is measured after reaching a stationary value. The diffusion capacity can be calculated from the volumetric concentration of carbon dioxide.

For smoking articles and particularly for smoking articles that should self-extinguish, there is often the desire to find a wrapping material where carbon monoxide can easily diffuse from the inside of the smoking article through the wrapping material into the surroundings, so that the carbon monoxide content in the smoke flowing out of the mouth end is low. This indicates a wrapping material with a comparably high diffusion capacity for gases. Conversely, it is also often desirable that oxygen should only diffuse with difficulty from the surrounding air through the wrapping material into the smoking article to ensure self-extinguishing of the smoking article in accordance with legal requirements. Thus, there exists a certain conflict of goals for the selection or design of a wrapping material with respect to its diffusion capacity.

In some cases the converse can be intended, i.e. that harmful gases such as carbon monoxide should remain in the tobacco column of the smoking article and only diffuse with difficulty through the wrapping material into the surroundings, to mitigate the harmful effect of passive smoking, while oxygen from the surroundings should be able to diffuse comparably easily through the wrapping material, to ensure continued smoldering of the smoking article and to reduce the rate of generation of carbon monoxide by increasing the availability of oxygen. In this case too, the result can be a conflict of goals, as described above, —but in reverse.

SUMMARY OF THE INVENTION

It is the object of the invention to provide a wrapping material for a smoking article, which helps to achieve an optimal compromise between the diffusion of CO from the inside of the smoking article to the outside and the diffusion of oxygen from the outside into the smoking article.

This object is achieved by a wrapping material according to claim 1 and a smoking article according to claim 28. Advantageous further embodiments are disclosed in the dependent claims.

The wrapping material according to the invention has a laminar shape, which extends in two mutually orthogonal spatial directions X and Y much further than in a third spatial direction Z orthogonal with respect to the spatial directions X and Y. In this regard, the spatial Z-direction can be understood as the "direction of thickness" in the usual manner. The wrapping material exhibits, at least in a part, a first and a second diffusion capacity $D_1$ and $D_2$ for the diffusion of $CO_2$ through the wrapping material in the +Z-direction and in the −Z-direction, respectively. in this respect, the values for the diffusion capacity $D_1$ and $D_2$ are to be determined according to CORESTA Recommended Method No. 77. For the wrapping material according to the invention, one or both of the following relationships (i) and (ii) holds or hold for the first and the second diffusion capacity $D_1$ and $D_2$, each for an average of 10 values:

$$|D_1-D_2|\geq 0.03 \text{ cm/s} \quad \text{(i)}$$

at a probability of error of 1%

$$2\frac{|D_1-D_2|}{D_1+D_2}\geq 0.030 \quad \text{(ii)}$$

The term "at a probability of error of 1%" in feature (i) means that the probability that the diffusion capacities differ by less than an absolute amount of 0.03 cm/s is less than 1%. A calculation rule for calculating the probability of error is disclosed in the description of the preferred embodiments.

Accordingly, the wrapping material according to the invention has a directional diffusion capacity in the Z-direction, i.e. in the thickness direction. The values for $D_1$ and $D_2$, which characterize the diffusion properties of the wrapping material, relate, for example, to the diffusion capacity of $CO_2$ since, particularly for the measurement of the diffusion capacity of this gas, a standardized method has been proposed as CORESTA Recommended Method No. 77, which provides highly repeatable results. The final version of CORESTA Recommended Method No. 77 is now well established and is known to the applicant and to other manufacturers of cigarette papers due to their participation in the Physical Test Methods Sub-Group of CORESTA; its publication is imminent. It should be understood, however, that the $CO_2$ diffusion capacities are also indicative of those for other gases, particularly $O_2$ and CO, as a higher diffusion capacity for $CO_2$ indicates a higher diffusion capacity for CO and $O_2$ and vice versa.

The invention is based on the surprising finding that wrapping materials for smoking articles can be produced for which the diffusion capacity is directional in the Z-direction or thickness direction. This is surprising behavior for a wrapping material of smoking articles that contradicts the expectations of the skilled person. Instead, for normal wrapping materials of smoking articles, for example for commercial cigarette papers, the skilled person would expect the diffusion behavior to be appropriately described by Fick's first law:

$$J=-D\frac{\partial c}{\partial z}$$

where J is the mass flow ($mol\cdot m^{-2}\cdot s^{-1}$), c the molar concentration, D the diffusion coefficient ($m^2\cdot s^{-1}$) and z (m) a coordinate in the Z-direction. It is immediately apparent from Fick's first law that reversing the direction of the concentration gradient also means that the direction of the mass flow will be reversed, but the absolute mass flow remains unchanged.

The present invention proposes a new class of wrapping materials for smoking articles, for which Fick's diffusion model is no longer directly applicable, but which instead exhibit a directional diffusion capacity. Although the origin of this effect is not yet fully clarified, a general structure of a wrapping material, which promises such a behavior, can nonetheless be disclosed. Simulations and specific exemplary embodiments, which are presented in detail below, confirm that the inventor's understanding with respect to an appropriate structure is correct and that the effect of a directional diffusion capacity is not only of theoretical nature, but in fact provides an essential practical contribution to the achievement of the objective.

As mentioned initially, a wrapping material according to the invention for smoking articles is a laminar material, and thus extends substantially further in two different spatial directions X and Y than in a third direction Z orthogonal to the other two spatial directions. This third direction is called the thickness direction or Z-direction and the thickness of the material at one position is its extension in the thickness direction at this position. The wrapping material has two approximately parallel lateral faces, which can be arbitrarily called upper face and lower face. The material can be divided into three virtual layers by two virtual middle faces $A_1$ and $A_2$. The middle faces $A_1$ and $A_2$ run within the material between the two lateral faces and are at each point separated from the upper and the lower face by at least on tenth of the thickness of the material at this point. The middle face $A_1$ is therefore located closer to the upper face than the middle face $A_2$ at every point and analogously, the middle face $A_2$ is located closer to the lower face than the middle face $A_1$ at every point. The two virtual middle faces $A_1$ and $A_2$ are separated from each other at every point by at least on tenth of the thickness of the material at that point.

The part of the wrapping material that is located between the upper face and the virtual middle face $A_1$ defines an upper virtual layer, while the part of the wrapping material that is located between the lower face and the middle face $A_2$ defines a lower virtual layer. Analogously, a central virtual layer is defined by the part of the wrapping material located between the middle faces $A_1$ and $A_2$.

The inventor has found that said directional diffusion capacity in the thickness direction can be obtained if the upper virtual layer has a lower coefficient of diffusion than the lower virtual layer, and the coefficient of diffusion of the central virtual layer does not substantially exceed the coefficient of diffusion of the lower virtual layer and does not substantially fall below the coefficient of diffusion of the upper virtual layer.

As is shown in the exemplary embodiments, such a material has a higher diffusion capacity for carbon dioxide in nitrogen from the lower face to the upper face than in the reverse direction. The diffusion capacity is hence directional in the Z-direction. In this regard, the terms "upper" and "upper face" and "lower" and "lower face" are chosen arbitrarily, and the virtual layer with the lower coefficient of diffusion will be called the "upper virtual layer" solely for the purposes of an easier verbal description.

The "coefficient of diffusion" here should be considered to relate to the coefficient of diffusion D from the aforementioned Fick's law, which is a measure of the mobility of particles in a material, i.e. a specific material property, and it is given in the unit $m^2/s$. In contrast to the diffusion properties of wrapping materials for smoking articles are usually described in the art by the diffusion capacity, which describes the gas volume passing through per unit time, per unit area and per concentration difference and hence has the unit m/s or cm/s. Nonetheless it should be understood that, for a wrapping material of a given thickness, the higher the diffusion capacity, the higher the coefficient of diffusion of the material.

The directional diffusion capacity according to the invention can be determined by measuring the diffusion capacity of the entire wrapping material twice according to CORESTA Recommended Method No. 77, once such that the lower face of the material is facing the half-chamber into which carbon dioxide is passed, whereby the value $D_1$ for the diffusion capacity is obtained, and once such that the upper face is facing the half-chamber into which carbon dioxide is passed, whereby the value $D_2$ for the diffusion capacity is obtained. It is found that the difference in the diffusion capacities, $\Delta D=D_1-D_2$, is then always positive and highly statistically significantly different from zero. For statistical validation, the measurement will be repeated several times, typically ten times, on each face at different positions.

As the virtual layer model described above should primarily be considered to describe the general structure of a wrapping material for which the directional diffusion capacity according to the invention can be expected. In the present disclosure, four ways are disclosed for the specific production of such wrapping materials, and the concept behind all these four ways is oriented towards the virtual layer model described above. At the same time, the model of virtual layers provides the skilled person with guidelines for the development of further options to produce a wrapping material according to the invention. The invention, however, is not limited to the methods for the production of a wrapping material according to the invention specifically described herein. The above virtual layers model also primarily serves as an explanation of the underlying structure of a wrapping material according to the invention as an indication to the skilled person as to how wrapping materials according to the invention can be produced in ways other than those specifically described here. It does, however, not serve to describe the object for which protection is sought, as the virtual layers will in general be non-physical layers within the material and the coefficients of diffusion of the individual virtual layers can hardly be determined reliably in the finished wrapping material. Rather, the present invention relates to all wrapping materials for smoking articles for which the diffusion capacities $D_1$ and $D_2$ differ in the +Z-direction and the −Z-direction in the manner defined above.

As mentioned initially, the difference in diffusion capacities $D_1$ and $D_2$ for a wrapping material according to the invention should be at least 0.03 cm/s, but preferably at least 0.05 cm/s, particularly preferably at least 0.07 cm/s and especially preferably at least 0.1 cm/s. The positive effect will be the greater the greater the difference in the diffusion capacities $D_1$ and $D_2$. Alternatively, the absolute difference in the diffusion capacities $\Delta D=|D_1-D_2|$ should be at least 3.0% of the mean diffusion capacity $(D_1+D_2)/2$, preferably at least 5.0% of the mean diffusion capacity and particularly preferably at least 8.0% of the mean diffusion capacity. The two diffusion capacities $D_1$ and $D_2$ and their mean value $(D_1+D_2)/2$ can be in the typical range for wrapping materials for smoking articles and are at least 0.005 cm/s, preferably at least 0.05 cm/s, particularly preferably at least 0.1 cm/s and/or at most 8.0 cm/s, preferably at most 6.0 cm/s and particularly preferably at most 5.0 cm/s.

In areas of the wrapping material that should serve for self-extinguishing of the smoking article, the mean value $(D_1+D_2)/2$ for the diffusion capacities $D_1$ and $D_2$ should be at least 0.005 cm/s and at most 0.5 cm/s, while in areas that do not have this function, the diffusion capacity can be up to 8.0 cm/s.

The areas in which the effect according to the invention of a directional diffusion capacity in the Z-direction is present do not have to extend over the entire surface of the wrapping material; instead, they can comprise only parts. Preferably, the part of the entire surface of the wrapping material that has a directional diffusion capacity is at least 5% of the entire surface area, preferably at least 10% of the entire surface area and particularly preferably at least 25% of the entire surface area.

In a particularly preferably embodiment, the diffusion capacity is directional in those areas that were applied in order to become self-extinguishing, measured in accordance with ISO 12863. The fraction of areas in which the diffusion capacity is directional can be between 20% and 40% of the total surface area.

The term total surface area should be understood to mean the total area of a representative sample of a reel of wrapping material, and also the area of a wrapping material taken from a smoking article and used to determine the diffusion capacity. Thus, for example, areas in which the wrapping material is glued to itself or to other materials are excluded.

The thickness of the wrapping material should be at least 5 μm, as at lower thicknesses the diffusion through the wrapping material will be strongly influenced by edge effects and the effect according to the invention no longer occurs to a sufficient extent. Preferably, the wrapping material is at least 10 μm thick, particularly preferably at least 20 μm and especially preferably at least 30 μm. The wrapping material should not be too thick, otherwise the path for diffusion through the wrapping material is too extensive and the desired quick gas exchange is no longer ensured. The thickness should, therefore, be at most 300 μm, preferably at most 150 μm, particularly preferably at most 100 μm and especially preferably at most 80 μm.

The basis weight of the wrapping material is preferably at least 10 $g/m^2$, preferably at least 15 $g/m^2$, particularly preferably at least 20 $g/m^2$ and/or at most 200 $g/m^2$, preferably at most 100 $g/m^2$ and particularly preferably at most 80 $g/m^2$.

In a preferred embodiment, the wrapping material comprises at least two plies, which are connected in close physical contact. The diffusion capacity of the uppermost ply hereby is lower than the diffusion capacity of the lowermost ply according to the convention selected in the present disclosure.

While the aforementioned "virtual layers" of the wrapping material solely designate geometrical regions of the material and can thus be purely virtual, the "plies" designate separately produced components of the wrapping material, which can be stacked upon each other. "Separately produced" in this context can mean that the plies are produced completely separately from each other, that is, for example, in the case of paper plies in production processes carried out one after another on the same or even on different paper machines. However, the formation of a ply that is formed in a separate process step during the production of the wrapping material can also be construed as "separate" production, as will be explained below.

The difference in the diffusion capacities of the lowermost and uppermost ply should be at least 0.05 cm/s, preferably at least 0.1 cm/s, particularly preferably at least 0.5 cm/s and especially preferably at least 1.0 cm/s. The difference should be at most 6.0 cm/s, preferably at most 5.0 cm/s and particularly preferably at most 4.0 cm/s. Generally, a large difference in the diffusion capacity of the lowermost and uppermost ply is beneficial for the effect according to the invention of a directional diffusion capacity in the Z-direction. The diffusion properties of the individual plies should be considered here to be described by their diffusion capacity in the usual manner. It goes without saying, however, that this also applies qualitatively to the corresponding coefficients of diffusion, that is, the ply with the higher diffusion capacity also has the higher coefficient of diffusion for a comparable thickness.

Alternatively the diffusion capacity of the uppermost ply should be at least 1%, preferably at least 5%, particularly preferably at least 10% and/or at most 95%, preferably at most 80% and particularly preferably at most 50% of the diffusion capacity of the lowermost ply. The use of different plies is a preferred manner of forming the virtual layers with differing coefficients of diffusion described above and hereby derives itself from the general structure described above, for which a directional diffusion capacity may be expected.

The ply/plies located between the lowermost and uppermost ply of the wrapping material, if present, can have any diffusion capacity, but it may not be so high that a considerable dead volume is formed by the porosity of this intermediate ply, and it may not be so low that diffusion through the wrapping material is entirely impossible. Preferably, the diffusion capacity of the intermediate ply/plies should be at least 50% of the diffusion capacity of the uppermost ply and at most 200% of the diffusion capacity of the lowermost ply and particularly preferably, the diffusion capacity of the intermediate ply/plies should be at least the diffusion capacity of the uppermost ply and at most the diffusion capacity of the lowermost ply.

If the wrapping material consists of more than one ply, the coefficient of diffusion of the individual plies need not be directional in the Z-direction. Rather the directionality is caused by the composite of several plies. If, however, there already exists a directionality in the Z-direction in the individual plies, the value for the diffusion capacity of a ply is to be understood to be the average of the diffusion capacities for the two directions.

The close physical contact between the plies is important, so that no dead volume is present between the plies, which can act as a reservoir and slow the diffusion, especially as long as no stationary state has been reached. This close physical contact can be produced by applying mechanical pressure to the plies, with the optional application of elevated temperatures. The pressure and temperature should be selected as a function of the material.

Layering two or more plies with different diffusion capacities on top of one another along with close physical contact in order to avoid a dead volume constitutes a first mode for the formation of a wrapping material according to the invention.

A second variation, which is conceptually related to the first variation, relates specifically to a wrapping material formed by a paper. According to this variation, two head boxes are used for the production of the paper, from which different pulp suspensions are applied on top of each other on the wire-section of the paper machine. The pulp suspensions differ in one or more of the properties pulp type, degree of refining, filler and/or content of filler in a manner that would result in different coefficients of diffusion or, for the same thickness, in different diffusion capacities. As an example, a high degree of refining and low filler content result in a paper or a ply of the paper, respectively, with a comparably low coefficient of diffusion.

In this embodiment as well, the plies are formed "separately", that is, in separate or discernible process steps, even if they are carried out simultaneously.

In a further embodiment at least one ply of the wrapping material is perforated. The selective use of perforations provides a third mode of forming the wrapping material according to the invention. The perforation can be carried out using various methods known in the prior art. As an example, mechanical perforation, electrostatic perforation or laser perforation can be utilized. Perforation serves to increase the porosity of the wrapping material and consequently its diffusion capacity.

The directionality of the diffusion capacity can then be achieved in various ways.

In embodiments in which the wrapping material is produced from at least two plies and in which at least one ply is perforated, a directional diffusion capacity can be obtained by perforating at least the lowermost ply, so that its porosity and the diffusion capacity are increased. The uppermost ply can also be perforated, but at most such that its diffusion capacity does not exceed the diffusion capacity of the lowermost ply and the aforementioned limits for the diffusion capacities and their differences are complied with. Not least for optical reasons a perforation of the uppermost ply is not preferred in many cases, as in the majority of cases, in which a higher diffusion capacity is targeted for gas transport from the inside of the smoking article to the outside rather than in the opposite direction, it will be located at the outside of the smoking article. The ply/plies located between the lowermost and uppermost ply, if present, can be perforated, but also here the limits for the diffusion capacity indicated above should be complied with.

In the case in which the wrapping material consists of a plurality of plies, any of the conventional perforation methods are suitable in principle, but those that are preferred are those that can produce more small holes than large holes. Thus, electrostatic perforation and laser perforation are preferred, particularly preferably electrostatic perforation.

In the case in which the wrapping material consists of a single ply only, a directional diffusion capacity can be achieved by perforation methods that can produce perforation holes the cross sectional area of which varies over the thickness of the wrapping material. In particular, the average cross sectional area of the perforation holes on the lower face should be at least 30%, preferably at least 40% larger than the cross sectional area of the perforation holes of the upper face.

Such perforation holes are preferably produced by means of laser perforation or mechanical perforation, particularly preferably by means of laser perforation, because with this method, smaller holes can be produced. With mechanical perforation, the perforation according to the invention can be accomplished, for example, with—deviating from conventional shapes—conically shaped perforation tools, while for laser perforation, the laser beam can be focused by appropriate lenses in a sufficiently conical shape instead of the common parallel shape, so that the holes perforated in this manner also have a conical shape and the cross sectional area of each such perforation hole decreases from the lower face to the upper face. It can be seen that all of the modes of obtaining a directional diffusion capacity described here are related to the aforementioned general structure of virtual layers with different coefficients of diffusion.

Any material can be used to constitute the one or more plies of wrapping material, but besides the obvious technical properties, it often has to comply with legal requirements, as it is smoked with the smoking article, and it should meet the consumer's expectations with respect to its behavior on the smoking article, for example, with respect to smoldering rate, influence on taste, color and other optical, tactile or olfactory properties.

If the wrapping material consists of more than one ply, the materials can be the same or of a different kind. Paper, reconstituted tobacco, tobacco leaves or tobacco substitutes are contemplated.

In a particularly preferred embodiment, at least one of the one or more plies of the wrapping material is formed by paper, particularly by a known cigarette paper or plug wrap paper, that is, papers that were designed as cigarette or plug wrap paper when used as a single-ply paper.

Basically, apart from cigarette paper and plug wrap paper, known tipping papers or other papers with adequate properties can be contemplated as paper.

Appropriate papers for the purposes of the invention contain at least pulp fibers, which can be derived, for example, from wood, flax, hemp, sisal, abaca, cotton, esparto grass or other raw materials. Pulp fibers from wood, flax and hemp are preferred. In addition, mixtures of different pulp fibers can be used.

In addition to pulp fibers, fillers, typically mineral fillers, especially chalk, can also be employed, whereby precipitated chalk is preferred for its purity. The fraction of filler in the paper pulp can be between 0% and 60%, preferably between 20% and 50% of the paper pulp. The particle size distribution, the crystal structure and the shape of the filler play a minor role for the purposes of the invention and can be selected according to their influence on the diffusion capacity known from the prior art.

The paper can contain burn additives, for example to influence the smoldering rate of the smoking article. Trisodium and tri-potassium citrate and mixtures thereof are particularly appropriate. The group of burn additives, with which the invention can be carried out, additionally comprises citrates, malates, tartrates, acetates, nitrates, succinates, fumarates, gulconates, glycolates, lactates, oxylates, salicylates, α-hydroxy caprylates, bicarbonates, carbonates and phosphates and mixtures thereof.

Burn additives are preferably contained in the paper in a fraction of 0 to 7% referred to the paper pulp, preferably from 0 to 3% referred to the paper pulp.

For the diffusion capacity of the paper the same limits apply as described further above for the wrapping material and the plies forming the wrapping material.

The basis weight of the paper is at least 10 $g/m^2$, preferably at least 15 $g/m^2$ and particularly preferably at least 20 $g/m^2$. It should at most be 100 $g/m^2$, preferably at most 80 $g/m^2$ and particularly preferably at most 60 $g/m^2$.

The thickness of the paper should be at least 10 μm, preferably at least 20 μm and particularly preferably at least 30 μm. The thickness of the paper should be at most 200 μm, preferably at most 120 μm and particularly preferably at most 80 μm.

The use of paper for one or more plies of the wrapping material can be combined with the perforation explained above or the provision of areas to obtain self-extinguishing.

A wrapping material of several plies of paper, for which a relevant dead volume does not occur between the plies, can be manufactured by the application of pressure. As an example, the plies can be passed through a nip between two rollers with a line-load between 2 N/mm and 10 N/mm. The rollers can be heated thereby to temperatures between 80° C. and 120° C. and the paper can be humidified before being passed through the rollers.

Alternative methods, for example engrailing or gluing the plies, are not preferred because of the associated greater influence on the diffusion capacity of the wrapping material. In addition, it is not preferred to simply stack the plies of wrapping material loosely upon each other, because then, under certain circumstances, the diffusion capacity of the virtual middle ply between the plies can be too high or a considerable dead volume is formed.

If the wrapping material consists of only one ply of paper, production of the paper on the paper machine also offers possibilities for producing a directional diffusion capacity in the Z-direction. This is a fourth variation, to create a wrapping material according to the invention for a smoking article. On common Fourdrinier paper machines, an aqueous pulp suspension is conveyed from a head box onto the wire of the paper machine. On the wire, the suspension is de-watered by gravity and by low pressure generated by so-called suction boxes or by appropriately profiled foils, and the paper sheet is formed. Then the paper passes into the press and drying section, to be further dried and finally rolled up. De-watering by gravity and low pressure on the wire occurs in just one direction and results in two-sidedness of the paper, that is, differences in the properties of the two sides of the paper. These differences relate, for example, to the smoothness and the filler content, which are both higher on the side facing away from the wire. Generally, one tries to limit this two-sidedness, and for the machine settings known in the prior art it is also not sufficiently pronounced to produce a detectable directionality in the diffusion capacity. However, it is possible to change the porous structure of the side in contact with the wire, for example, by extraordinarily strong low pressure in the suction boxes or by appropriate blade angles of the foils, such that the porosity and thereby the diffusion capacity of a virtual layer of the paper closer to the wire is considerably increased compared to a virtual layer of the paper facing away from the wire.

As a result, this causes a directional diffusion capacity in the Z-direction and by proper selection of the process parameters, resulting in a wrapping material according to the invention. The low pressure has to be selected to be higher than the usual values for paper production and depends on the configuration of the paper machine. The skilled person will easily be able to find the required settings by experimentation.

This effect can be utilized in a particularly advantageous manner for wrapping materials for smoking articles, because the side of the paper facing the wire during paper production is typically facing the tobacco on a smoking article. By application of the method according to the invention, the diffusion capacity in the direction from the tobacco column to the surroundings is greater than the other way round, whereby positive effects regarding the carbon monoxide content in the smoke flowing out of the mouth end of the smoking article can be expected.

In a further embodiment, a smoking article is formed from the wrapping material, which comprises a tobacco column wrapped by the wrapping material. In a further preferred embodiment, the smoking article also comprises a filter, the front of which is connected with the wrapped tobacco column. In a particularly preferred embodiment, the smoking article is a filter cigarette.

Depending on in which direction the gas transport by diffusion is to be facilitated, the wrapping material will be arranged around the tobacco column. If better gas transport from the tobacco column of the smoking article to the surroundings is desired, the lower face of the wrapping material will face the tobacco column. In contrast, if gas transport to the tobacco column is to be facilitated, the upper face of the wrapping material will face the tobacco column.

Methods known from the prior art can be considered for the production of the smoking article. Particularly, the smoking article can be produced by machine, manually or partially manually from the wrapping material, tobacco and other optional components.

The following exemplary embodiments are intended to demonstrate the effect according to the invention.

DESCRIPTION OF THE PREFERRED EMBODIMENTS

Figure 1A:
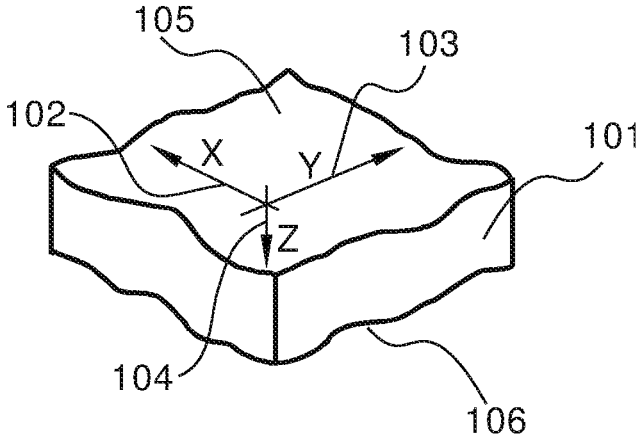
FIG. 1*a* shows a perspective view of a wrapping material, which illustrates its geometry.
Figure 1B:
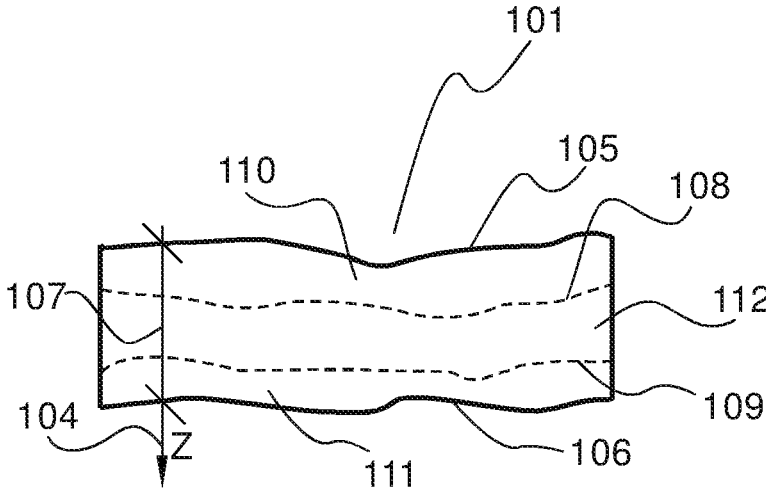
FIG. 1*b* shows a sectional view of the wrapping material of FIG. 1*a*.

Firstly, the general structure of a wrapping material according to one embodiment of the invention should be explained referring to FIGS. 1*a* and 1*b*.

The wrapping material 101, shown in FIGS. 1*a* and 1*b*, is a laminar structure and therefore it extends substantially further in a direction X, tagged 102, and a different direction Y, tagged 103, than in a third direction Z, tagged 104, which is orthogonal to the X-direction 102 and the Y-direction 103. The wrapping material has an upper face 105 and a lower face 106, wherein the designations are arbitrarily selected and in particular do not need to coincide with the term upper side, known from paper production. The Z-direction 104 defines the thickness 107 of the wrapping material is defined at each point by the distance between the upper face 105 and the lower face 106.

In FIG. 1*b* a virtual middle face $A_1$, tagged 108, is also shown, which is separated from the upper face 105 at every point by at least one tenth of the thickness of the wrapping material at this point. A further virtual middle face $A_2$, tagged 109, is also shown in FIG. 1*b*, which is separated from the lower face 106 at every point by at least on tenth of the thickness of the wrapping material at this point. The virtual middle faces $A_1$, 108, and $A_2$, 109, are themselves separated from each other, again by at least one tenth of the thickness of the wrapping material at every point and are located such that the virtual middle face $A_1$, 108, is closer to the upper face 105 at every point than the virtual middle face $A_2$, 109.

The upper face 105 and the middle face $A_1$, 108 define a virtual upper layer 110 of the wrapping material lying between these two faces. In addition, a virtual lower layer 111 is defined between the lower face 106 and the middle face $A_2$, 109. In an analogous manner, the virtual middle layer 112 is defined by the part of the wrapping material between the middle face $A_1$, 108, and the middle face $A_2$, 109.

The wrapping material in the present exemplary embodiment is characterized in that the diffusion capacity of the virtual upper layer 110 or the coefficient of diffusion of the material, respectively, in this virtual upper layer 110 is lower than that of the virtual lower layer 111, and that the diffusion capacity or the coefficient of diffusion, respectively, of the virtual middle layer 112 does not substantially exceed the diffusion capacity or the coefficient of diffusion, respectively, of the virtual lower layer 111 and does not substantially fall below the diffusion capacity or the coefficient of diffusion, respectively, of the virtual upper layer 110.

Thus, overall, a wrapping material is created with a diffusion capacity that is directional in the Z-direction. In particular, the diffusion capacity for carbon dioxide in nitrogen is higher from the lower face to the upper face than in the opposite direction.

Although the origin of the effect according to the invention is not fully explained, it is in any case certain that it cannot be discerned from the model equation of diffusion obvious to the skilled person, that is, from Fick's law mentioned above.

From this it would follow that by reversing the direction of the concentration gradients, the direction of the mass flow is also reversed, but the absolute mass flow remains the same. Fick's law in this form is only valid for free diffusion. The model equation for diffusion in porous materials, however, is very often based on this equation, but uses a reduced coefficient of diffusion corresponding to the porosity of the material. Thus, according to such a simple model, the absolute mass flow is also invariant with respect to reversing the direction of the concentration gradient in porous materials.

It is only when the porous material is no longer considered to be a continuum and instead, diffusion through individual pores is described using a more complex model, for example a numerical solution of the corresponding equations with pores which narrow in a stepwise or continuous manner under appropriate boundary conditions, can it be seen that a reversal of the direction of the concentration gradients not only causes a reversal in the direction of the mass flow, but also a change in its absolute value. The wrapping materials according to the invention utilize this effect.

All measurements of the diffusion capacity were carried out in accordance with CORESTA Recommended Method No. 77 on a Diffusivity Tester A50 from the company Borgwaldt KC.

Comparison Examples

For comparison, five cigarette and plug wrap papers from the prior art were used and in a first step, it was checked that these conventional papers, designated as A to E, do not exhibit the effect according to the invention.

In Table 1 the thickness of the conventional papers A to E and their basis weight are given. The diffusion capacity of each of the papers A-E was measured at different positions 10 times. Mean values (MW) and standard deviations (STD) are labeled with "Measurement 1" and are shown in Table 1. Afterwards the papers were flipped over, so that now the other face of the paper was facing the half-chamber of the measurement instrument containing carbon dioxide. Again, 10 measurements at different positions were carried out and the corresponding mean value (MW) and the respective standard deviation (STD) are given as "Measurement 2" in Table 1. A t-test for comparison of the mean values of two samples, whose p-values are given in Table 1, shows that at a probability of error of 5%, no statistical differences exist in the diffusion capacity and therefore no directionality of the diffusion capacity in the Z-direction is detectable.

TABLE 1

Data for materials and comparison examples

| Material | | | Measurement 1 Diffusion Capacity | | Measurement 2 Diffusion Capacity | | |
|---|---|---|---|---|---|---|---|
| Basis | | | | | | | |
| Code | Weight g/m² | Thickness µm | MW cm/s | STD cm/s | MW cm/s | STD cm/s | t-Test p-Value |
| A | 22.0 | 38 | 1.16 | 0.04 | 1.18 | 0.03 | 0.224 |
| B | 25.0 | 44 | 2.24 | 0.03 | 2.23 | 0.03 | 0.466 |
| C | 26.0 | 58 | 2.26 | 0.04 | 2.22 | 0.05 | 0.065 |
| D | 24.5 | 72 | 4.04 | 0.08 | 3.98 | 0.07 | 0.092 |
| E | 21.0 | 69 | 5.43 | 0.09 | 5.51 | 0.09 | 0.062 |

Exemplary Embodiments

The papers A-E were now bonded together in all possible combinations of two papers by pressure between two rollers with a line load of 5 N/mm, wherein the rollers were heated to a temperature of 90° C. This resulted in 15 possible two-plied wrapping materials.

Of each of these 15 wrapping materials, the diffusion capacity was measured again. In a first measurement series, 10 measurements were carried out at different positions for each wrapping material, whereby the ply with the higher diffusion capacity was facing the half-chamber, into which carbon dioxide was passed. This measurement series was labeled "Measurement 3" and the corresponding mean values (MW) and standard deviations (STD) were calculated and are shown in Table 2.

After that, the wrapping materials were flipped over, so that now the ply with the lower diffusion capacity was facing the half-chamber into which carbon monoxide was passed. Again, 10 measurements at different positions were carried out for each wrapping material. The measurement series was labeled "Measurement 4" and the corresponding mean values (MW) and standard deviations (STD) were calculated and entered into Table 2.

For the wrapping materials, consisting of two plies of the same paper, that is AA, BB, CC, DD and EE, there is no difference between the diffusion capacities of the two plies. Consequently, in measurement series 3, an arbitrarily chosen first side and in measurement series 4 the second side of the wrapping material was facing the half-chamber into which carbon dioxide was passed.

As a technically relevant effect may be expected starting from a difference of 0.03 cm/s, a t-test was carried out to test whether the absolute difference of the mean values is greater than 0.03 cm/s with a probability of error of 1%. The t-test was carried out in the usual manner as follows:

Let $d_{1,i}$ and $d_{2,i}$, with i=1, 2, 3, . . . , 10 be the N=10 measured individual values of the diffusion capacity. The mean values $D_1$ and $D_2$ of the diffusion capacities are then estimated by $$D_1 = \frac{1}{N}\sum_{i=1}^{N} d_{1,i}$$

and $$D_2 = \frac{1}{N}\sum_{i=1}^{N} d_{2,i}$$

The standard deviations $s_1$ and $s_2$ of the individual values are estimated by $$s_1 = \sqrt{\frac{1}{N-1}\sum_{i=1}^{N}(d_{1,i} - D_1)^2}$$

and $$s_2 = \sqrt{\frac{1}{N-1}\sum_{i=1}^{N}(d_{2,i} - D_2)^2}$$

The absolute difference in the mean values, ΔD, is calculated by $$\Delta D = |D_1 - D_2|$$

The difference of the mean values is approximately normally distributed with a standard deviation s, given by $$s = \sqrt{\frac{1}{N}(s_1^2 + s_2^2)}$$

The test statistic t is determined by $$t = \frac{\Delta D - 0.03}{s}$$

whereby ΔD and s have to be given in cm/s.

If t>2.82, the null hypothesis $H_0$:ΔD<0.03 cm/s is to be rejected with an error probability of less than 1%, and the mean diffusion capacities $D_1$ and $D_2$ differ by more than 0.03 cm/s. The probability of an error is given in Table 2 as "p-value".

The results show that for all combinations of two different materials with the exception of the combination BC, the mean values for the diffusion capacity of measurement series 3 and 4 differ statistically by at least 0.03 cm/s with a probability of error of 1%. Hence, all these materials show a directional diffusion capacity with respect to the Z-direction.

For the material combination BC, the difference in the diffusion capacity of the plies B and C is only 0.02 cm/s, which is obviously not sufficient to statistically detect the effect according to the invention.

In this test, all five material combinations from the same material do not show a sufficiently large absolute difference in the mean diffusion capacity, which confirms that the directionality of the diffusion capacity is caused by the selection of the materials and not by the mechanical treatment during bonding of the plies.

TABLE 2

Data for exemplary embodiments

| | Measurement 3 Diffusion Capacity | | Measurement 4 Diffusion Capacity | | Difference of mean values | | t-Test ΔD > 0.03 | |
|---|---|---|---|---|---|---|---|---|
| Code | MW cm/s | STD cm/s | MW cm/s | STD cm/s | Measurements 3 and 4 cm/s | of the plies cm/s | t-statistic | p-Value |
| AA | 0.623 | 0.014 | 0.627 | 0.015 | −0.005 | 0.00 | −3.937 | 0.998 |
| AB | 0.780 | 0.021 | 0.698 | 0.012 | 0.082 | 1.08 | −6.735 | $<10^{-3}$ |
| AC | 0.776 | 0.018 | 0.688 | 0.013 | 0.088 | 1.10 | 8.318 | $<10^{-3}$ |
| AD | 0.850 | 0.031 | 0.688 | 0.012 | 0.162 | 2.88 | 12.593 | $<10^{-3}$ |
| AE | 0.970 | 0.016 | 0.811 | 0.020 | 0.159 | 4.27 | 15.976 | $<10^{-3}$ |
| BB | 1.114 | 0.034 | 1.091 | 0.025 | 0.023 | 0.00 | −0.502 | 0.686 |
| BC | 1.133 | 0.023 | 1.120 | 0.020 | 0.012 | 0.02 | −1.828 | 0.950 |
| BD | 1.401 | 0.025 | 1.263 | 0.025 | 0.138 | 1.80 | 9.724 | $<10^{-3}$ |
| BE | 1.577 | 0.033 | 1.440 | 0.029 | 0.137 | 3.19 | 7.707 | $<10^{-3}$ |
| CC | 1.163 | 0.025 | 1.180 | 0.020 | −0.018 | 0.00 | −1.200 | 0.870 |
| CD | 1.401 | 0.036 | 1.270 | 0.019 | 0.131 | 1.78 | 7.838 | $<10^{-3}$ |
| CE | 1.636 | 0.029 | 1.484 | 0.023 | 0.153 | 3.17 | 10.524 | $<10^{-3}$ |
| DD | 2.013 | 0.046 | 2.000 | 0.047 | 0.013 | 0.00 | −0.823 | 0.784 |
| DE | 2.277 | 0.047 | 2.165 | 0.046 | 0.111 | 1.39 | 3.901 | 0.002 |
| EE | 2.716 | 0.068 | 2.724 | 0.042 | −0.009 | 0.00 | −0.843 | 0.790 |

A further analysis of the data shows a relationship between the difference in the diffusion capacity of the two plies the extent of the directionality of the diffusion capacity, characterized by the difference in the diffusion capacity of measurement series 3 and 4

Figure 2:
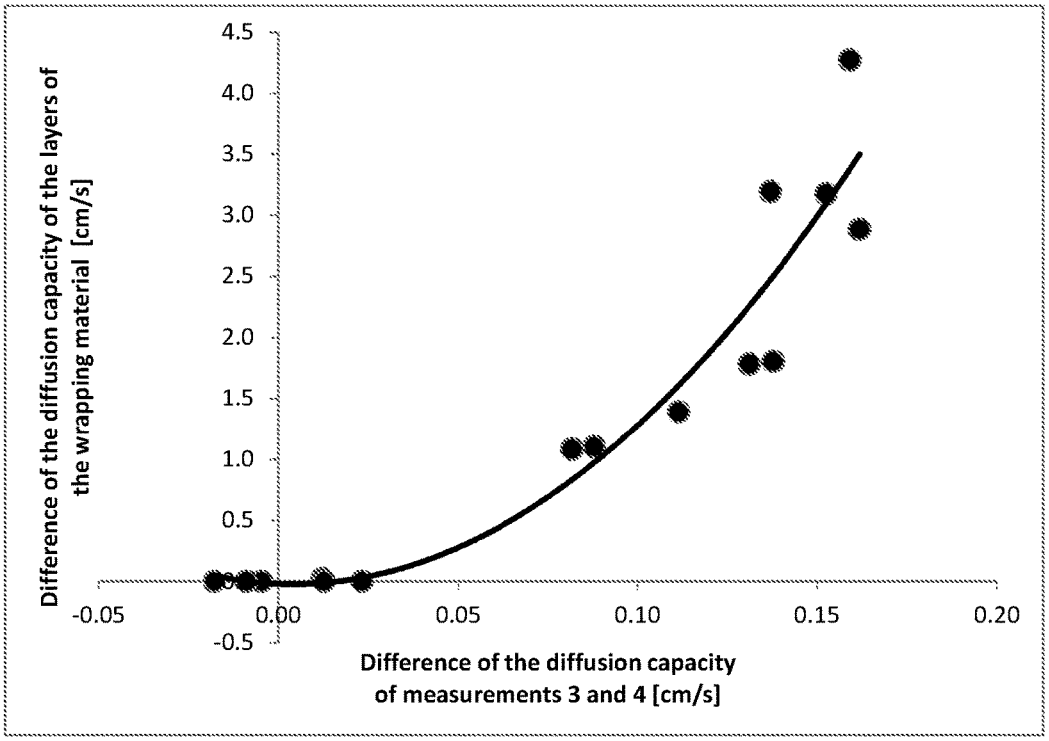
FIG. 2 is a diagram, which displays the relationship between the directionality of the diffusion capacity of the wrapping material and the difference in the diffusion capacity of the two plies constituting the two-plied wrapping material.

In FIG. 2, the data for all wrapping materials of Table 2 is shown, as well as a quadratic regression line, for which a coefficient of determination of 0.9122 results. This shows a rather good statistical relationship between these two parameters and coincides with the expectation that larger differences in the diffusion capacity between the plies also results in a larger directionality of the diffusion capacity of the wrapping material. Hence, this diagram suggests that the invention can also be employed for materials extending beyond these ranges.

To demonstrate the effect of appropriate perforation, a paper with a thickness of 70 μm and a basis weight of 78 g/m$^2$ was selected. This paper has an unperforated diffusion capacity of less than 0.01 cm/s, for which reason the directionality was not investigated further. The paper was then perforated in 6 tracks with an appropriately set-up laser. Between the tracks, running in parallel, there was a distance of 0.5 mm and on each track, 50 holes per cm were perforated. The laser was focused conically so that on one face of the paper, the holes had a diameter of about 0.1 mm, while on the other face, the diameter was typically 0.07 mm.

The diffusion capacity was measurement with a measuring head with an opening of 3×20 mm so that all 6 tracks were positioned parallel to the longer side of the measuring head under the opening of the measuring head. The measurement was carried out at 10 different positions. In a first series of measurements, the face with the larger hole diameter was facing the half-chamber containing carbon dioxide and a mean diffusion capacity of 0.163 cm/s at a standard deviation of 0.012 cm/s resulted. Afterwards, the paper was flipped over so that now the face with the smaller hole diameter was facing the half-chamber containing carbon dioxide. Again, the diffusion capacity was determined at 10 different positions and this resulted in a mean value of 0.103 cm/s with a standard deviation of 0.011 cm/s. A t-test to check if the absolute difference of the mean values exceeded a value of 0.03 cm/s showed a p-value of less than $10^{-3}$ and thereby a directional diffusion capacity in the Z-direction at a probability of error of 1%.

The invention claimed is:

1. Wrapping material for a smoking article, which has a laminar shape that extends further in two mutually orthogonal spatial directions X and Y than in a spatial direction Z orthogonal to the two spatial directions X and Y, whereby the wrapping material has, in at least a part of its area, a first and a second diffusion capacity $D_1$ and $D_2$ for the diffusion of $CO_2$ through the wrapping material in the +Z-direction and the −Z-direction respectively, wherein the diffusion capacities $D_1$ and $D_2$ are to be determined according to CORESTA Recommended Method No. 77, characterized in that for the diffusion capacity $D_1$ and $D_2$, each an average over 10 values, one or both of the following relationships (i) and (ii) holds or hold:

$$|D_1-D_2|\geq 0.03 \text{ cm/s} \quad \text{(i)}$$

(ii) with a probability of error of 1%

$$2\frac{|D_1-D_2|}{D_1+D_2}\geq 0.030.$$

2. Wrapping material according to claim 1, in which one or both of the following relationships (iii) and (iv) holds or hold for the first and second diffusion capacity $D_1$ and $D_2$:

$$|D_1-D_2|\geq 0.07 \text{ cm/s}, \quad \text{(iii)}$$

$$2\frac{|D_1-D_2|}{D_1+D_2}\geq 0.050. \quad \text{(iv)}$$

3. Wrapping material according to claim 1, in which $$\frac{D_1+D_2}{2}\geq 0.01 \text{ cm/s}$$

and $$\frac{D_1+D_2}{2}\leq 5.0 \text{ cm/s}.$$

4. Wrapping material according to claim 3, in which, in a section of the wrapping material, which is intended for self-extinguishing of a smoking article manufactured from the wrapping material, the following holds $$0.005 \text{ cm/s} \leq \frac{D_1 + D_2}{2} \leq 0.5 \text{ cm/s}.$$

5. Wrapping material according to claim 1, in which said part of the area of the wrapping material with the properties described in claim 1 accounts for at least 25% of the total area of the wrapping material.

6. Wrapping material according to claim 1, in which one or both of the relationships (i) and (ii) holds or hold in such areas of the wrapping material that are intended to obtain self-extinguishing of a smoking article manufactured therefrom, wherein these areas account for 20% to 40% of the total area of the wrapping material.

7. Wrapping material according to claim 1, with a thickness d for which the following holds: d≥10 μm and d≤100 μm.

8. Wrapping material according to claim 1, with a basis weight of at least 10 g/m$^2$ and at most 100 g/m$^2$ .

9. Wrapping material according to claim 1, which comprises at least two plies, which are with each other or with an intermediate ply located therebetween in close physical contact, wherein the two plies have different diffusion capacities.

10. Wrapping material according to claim 9, wherein the wrapping material has an upper face and a lower face, wherein one of the two plies is an uppermost ply that borders on the upper face, and one ply is a lowermost ply that borders on the lower face of the material.

11. Wrapping material according to claim 9, in which the absolute difference of the diffusion capacities of the two plies is at least 0.05 cm/s and at most 5.0 cm/s.

12. Wrapping material according to claim 9, in which the lower diffusion capacity of the two plies is at least 1% and at most 95% of the higher diffusion capacity of the two plies.

13. Wrapping material according to claim 10, in which the diffusion capacity of the uppermost ply is lower than that of the lowermost ply and in which an intermediate ply is located between the uppermost and the lowermost ply the diffusion capacity of which is at most 200% of the diffusion capacity of the lowermost ply and at least 50% of the diffusion capacity of the uppermost ply.

14. Wrapping material according to claim 9, in which the close physical contact can be obtained by mechanical pressure on the plies.

15. Wrapping material according to claim 9, in which both plies are formed by paper, which contains pulp and wherein the plies differ by one or more of the properties pulp type, degree of refining of the pulp, filler, if present, and/or filler content, if present.

16. Wrapping material according to claim 9, in which at least the ply having a higher diffusion capacity is artificially perforated.

17. Wrapping material according to claim 1, with an upper face and a lower face, whereby the coefficient of diffusion of a virtual layer that borders the upper face is lower than the coefficient of diffusion of a virtual layer that borders the lower face.

18. Wrapping material according to claim 1, in which the wrapping material is perforated, wherein the mean cross section of the perforation holes in a virtual layer bordering the upper face of the wrapping material is lower than in a virtual layer bordering the lower face.

19. Wrapping material according to claim 18, in which the mean cross sectional area of the perforation holes on the lower face is at least 30% larger than the mean cross sectional area of the perforation holes on the upper face.

20. Wrapping material according to claim 1, in which the wrapping material or the individual plies of the wrapping material consist of paper, reconstituted tobacco, tobacco leaves or tobacco substitute materials.

21. Wrapping material according to claim 20, in which the paper contains pulp fibers derived from wood, flax, hemp, sisal, abacá, cotton, or esparto grass.

22. Wrapping material according to claim 21, in which the paper contains at least one mineral filler.

23. Wrapping material according to claim 22, in which the fraction of the filler relative to the mass of the paper is between 20% and 50% of the total paper mass.

24. Wrapping material according to claim 1, which contains at least one burn additive selected from the group containing tri-sodium citrate, tri-potassium citrate, malates, tartrates, acetates, nitrates, succinates, fumarates, gluconates, glycolates, lactates, oxylates, salicylates, α-hydroxy caprylates, bicarbonates, carbonates and phosphates and mixtures thereof.

25. Wrapping material according to claim 24, in which the fraction of burn additive relative to the mass of the wrapping material is less than 3%.

26. Wrapping material according to claim 20, in which the paper has a basis weight of at least 10 g/m$^2$ and at most 100 g/m$^2$.

27. Wrapping material according to claim 20, in which the thickness of the paper is at least 10 μm and at most 200 μm.

28. Smoking article comprising a tobacco column and a wrapping material that surrounds the tobacco column, wherein the wrapping material is formed by a wrapping material according to claim 1.

29. Smoking article according to claim 28, in which the diffusion capacity for $CO_2$ from the tobacco column through the wrapping material towards the outside is greater than in the opposite direction.

30. Smoking article according to claim 28, at the end of which a filter is provided.

* * * * *